US010096894B2

(12) United States Patent
Kaufmann et al.

(10) Patent No.: US 10,096,894 B2
(45) Date of Patent: Oct. 9, 2018

(54) MULTIBAND, MONOPOLE ANTENNA ASSEMBLY

(71) Applicant: SAFEmine AG, Baar (CH)

(72) Inventors: Thomas Kaufmann, Zurich (CH); Urban Mäder, Ebertswil (CH)

(73) Assignee: SAFEMINE AG, Baar (CH)

( * ) Notice: Subject to any disclaimer, the term of this patent is extended or adjusted under 35 U.S.C. 154(b) by 0 days.

(21) Appl. No.: 15/388,780

(22) Filed: Dec. 22, 2016

(65) Prior Publication Data

US 2017/0179585 A1 Jun. 22, 2017

(30) Foreign Application Priority Data

Dec. 22, 2015 (EP) ..... 15201977

(51) Int. Cl.
*H01Q 1/32* (2006.01)
*H01Q 5/307* (2015.01)
(Continued)

(52) U.S. Cl.
CPC ..... *H01Q 1/3275* (2013.01); *H01Q 1/18* (2013.01); *H01Q 1/2291* (2013.01);
(Continued)

(58) Field of Classification Search
CPC ..... H01Q 5/307; H01Q 1/18; H01Q 1/3275; H01Q 5/357
(Continued)

(56) References Cited

U.S. PATENT DOCUMENTS 4,170,012 A * 10/1979 Kaloi ..... H01Q 21/205 343/700 MS
8,847,846 B1 * 9/2014 Diaz ..... H01Q 9/27 343/700 MS
(Continued)

FOREIGN PATENT DOCUMENTS

WO 02/080307 A1 10/2002
WO 2004/047047 A1 6/2004
(Continued)

OTHER PUBLICATIONS

Kaufmann, T., et al., "Low-Profile Magnetic Loop Monopole Antenna Based on a Square Substrate-Integrated Cavity", International Journal of Antennas and Propagation, vol. 2015, Article ID 694385, Jan. 2015, pp. 1-6.
(Continued)

*Primary Examiner* — Huedung Mancuso
(74) *Attorney, Agent, or Firm* — Maschoff Brennan

(57) ABSTRACT

A multiband antenna assembly for transmitting or receiving signals in at least two frequency bands is disclosed according to some embodiments. The multiband antenna assembly may include a monopole antenna with a base substrate and a top substrate having defined dimensions and shapes. In some embodiments, the base substrate and the top substrate are arranged with defined distance relative to each other and define a cavity. For example, a first frequency band is basically defined by the present distance. The top substrate may include at least one slot. A second frequency band basically is defined by the design and arrangement of the one slot. The second frequency band may be different from the first frequency band. The cavity may be designed so that the first and the second frequency band comprise preferred monopole sending and/or receiving directions substantially parallel to the extension of the substrates.

20 Claims, 3 Drawing Sheets

(51) Int. Cl.

| | |
|---|---|
| ***H01Q 1/18*** | (2006.01) |
| ***H01Q 1/22*** | (2006.01) |
| ***H01Q 1/24*** | (2006.01) |
| ***H01Q 1/38*** | (2006.01) |
| ***H01Q 1/42*** | (2006.01) |
| ***H01Q 1/48*** | (2006.01) |
| ***H01Q 13/10*** | (2006.01) |
| ***H01Q 9/04*** | (2006.01) |
| ***H01Q 9/36*** | (2006.01) |
| ***H01Q 5/357*** | (2015.01) |

(52) U.S. Cl.
CPC ..... *H01Q 1/241* (2013.01); *H01Q 1/32* (2013.01); *H01Q 1/38* (2013.01); *H01Q 1/42* (2013.01); *H01Q 1/48* (2013.01); *H01Q 5/307* (2015.01); *H01Q 5/357* (2015.01); *H01Q 9/0421* (2013.01); *H01Q 9/36* (2013.01); *H01Q 13/10* (2013.01)

(58) Field of Classification Search
USPC ..... 343/715
See application file for complete search history.

(56) References Cited

U.S. PATENT DOCUMENTS

| | | | | |
|---|---|---|---|---|
| 2004/0164916 | A1 | 8/2004 | Jecko et al. | |
| 2010/0207811 | A1* | 8/2010 | Lackey ..... | G01S 19/21 342/357.44 |
| 2011/0080323 | A1 | 4/2011 | Thiam et al. | |

FOREIGN PATENT DOCUMENTS

| | | | |
|---|---|---|---|
| WO | 2005/064745 | A1 | 7/2005 |
| WO | 2010/142046 | A1 | 12/2010 |

OTHER PUBLICATIONS

European Search Report dated Jun. 15, 2016 as received in Application No. 15201977.4.

* cited by examiner

MULTIBAND, MONOPOLE ANTENNA ASSEMBLY

FIELD

The invention generally pertains to a monopole antenna device for sending and/or receiving signals of at least two frequency bands designed to be implemented with a moving vehicle, in particular for vehicle-to-vehicle communication.

BACKGROUND

As communication techniques and applications become more and more attractive and important with view to mobile devices, the need for compact antennas increases accordingly. The size of such antennas compared to stationary solutions—is a significant issue. Moreover, properties like directional characteristics are of importance with respect of desired functions.

Concerning the field of vehicle communication, like communication from a car to another car, specific requirements have to be fulfilled with a respective antenna device which for example is an optimised radiation profile in a horizontal direction.

Regarding a more specific technical field of mine vehicles, a vehicle-to-vehicle communication is even more important for providing kind of proximity warnings and thus improved safety for e.g. persons or vehicles in a given area.

Surface mines and similar sites or areas are generally operated by means of a large number of vehicles and staff.

Some of the vehicles may be exceedingly large, heavy, and difficult to control. It has been proposed to use GNSS-devices (GNSS=global navigation satellite system, such as GPS) on board of vehicles and other objects, such as cranes, to generate proximity warnings in order to reduce the risk of collisions between vehicles. Such a system is e.g. described in WO 2004/047047 based on devices mounted to the objects. Each device comprises a GNSS receiver, a control unit deriving positional data using the signal of the GNSS receiver, a radio circuit for wireless exchange of the positional data with the other devices, and an output device for outputting proximity warnings. Such systems allow the driver of a vehicle to obtain information on some of the obstacles nearby. Another improved such system is known from WO 2010/142046 A1.

Corresponding to the use with automobiles, such communication device (radio circuit) needs to be designed and arranged at the respective moving vehicle such that a signal sent from that device propagates in a way to be suitably received by another such vehicle or central processing unit. For typical vehicle-to-vehicle or vehicle-to-receiving unit communication the signals are to be sent in substantially horizontal direction and/or the receiver comprises a respective preferred horizontal receiving direction.

Kaufmann, T. et al. propose in "Low-Profile Magnetic Loop Monopole Antenna Based on a Square Substrate-Integrated Cavity", International Journal of Antennas and Propagation, Volume 2015, Article ID 694385, a low-profile monopole antenna having a square substrate-integrated cavity radiating through apertures in its four side walls. Such antenna fulfils the crucial requirement of an omni-directional radiation pattern with maximum in or close to the substrate plane.

Promising geometries to achieve these requirements can be based on low-profile resonant cavities, with fringing fields from thin apertures forming equivalent magnetic currents as described therein. The antenna is a square patch monopole completely integrated in a substrate using shorting vias. Compared to prior art, this antenna combines compactness and low profile, while the proposed approach provides a new perspective to planar monopole antenna design: instead of being considered a loaded monopole, the structure is interpreted as an opened rectangular cavity. The radiation originates from four regions along the side walls, which effectively creates a square-magnetic current loop. This results in an equivalent electric monopole antenna that is radiating omni-directionally, is compact, is of low-profile and is robust to tolerances.

However, such solution focuses on omni-directional radiation for only one defined frequency (5.8875 GHz in the DSRC band), wherein (simultaneously) different frequency bands are typically used for vehicle communication purpose. In addition, as for integration in a moving vehicle receiving and processing of a GNSS signal is required as well, the problem of suitable combination of such devices or signal still remains.

WO 02/080307 A1 proposes an antenna device comprising two or more antennas in a single housing/radome. A first top loaded, monopole antenna is nested within a ground plate and a top plate of a second top loaded, monopole antenna.

Additionally, a further microstrip antenna may be positioned on top of the second monopole antenna. The first antenna may be designed to transmit and receive in the AMPS bandwidth, the second antenna in the PCS bandwidth and the microstrip antenna in the GPS bandwidth. Due to the design of the combined antennas the overall size and complexity of the antenna device is quite disadvantageous with corresponding negative impact on flexibility of mounting or integrating the device onto or into a moving vehicle.

SUMMARY

Some embodiments of the present invention provide improved communication means, in particular for a moving vehicle, of compact design and respectively adjusted directional characteristic.

Some embodiments of the invention provide a respective antenna device which provides improved transmitting and/or receiving within at least two different radio frequency bands.

Some embodiments of the invention provide an improved compact antenna device which still provides compact design in combination with a GNSS receiver or transmitter.

Some embodiment of the invention relate to a low-profile cavity-backed planar monopole antenna having a top plate and typically being arranged so that a ground plate is provided as well. In particular the plates are of substantially equal dimensions and arranged with defined distance basically parallel to each other. The resonance cavity defined by the base substrate (ground plate) and the top substrate (top plate) defines a first frequency band provided by the antenna device. The apertures on side of the cavity provide respective directional characteristics.

The top substrate comprises a number of areal slots (at least one) which in self-synergy and/or in synergy (interaction) with the defined cavity provides a second frequency band different from the first frequency band.

Such arrangement provides, for example, both two frequency bands which respective signals are suitably transmitted and/or received within and an optimised radiation characteristic for those frequency bandwidths with view to use with mobile moving vehicles. An optimum of radiation magnitude is thus given substantially parallel to the extensions of the base and the top substrate in every direction (omni-directional, circle-like), e.g. a maximum radiation level (across a virtual sphere) is given according to an intersection of a plane between the top and the base substrate and a sphere whose centre point corresponds to a centre point of the cavity. That intersection can also be understood as the equator of the sphere. In particular, the magnitude of sending radiation and/or the level of reception quality decreases with increasing distance from the intersection line (equator) across the sphere, e.g. towards the poles of the sphere.

Therefore, the antenna device provides very good sending and receiving properties with view to integration in an automobile or other vehicle being desired to enable vehicle-to-vehicle communications. The antenna could e.g. be mounted inside or onto the roof of the respective vehicle in respective orientation so that the preferred radiation direction of the antenna basically corresponds to a horizontal plane in normal position and/or in moving conditions of the vehicle.

With the proposed design of the invention, the cavity antenna does however not necessarily require a dedicated metal mount to act as ground plane of the cavity, as the fields are completely formed through the cavity apertures (this is different to classical monopole antennas, which require a (relatively large) ground for to maintain the symmetry). According to that the metal mount may be represented by a surface of a body onto which the multiband antenna assembly is mounted, in particular by a housing of a radome, a part of a roof of a vehicle or by a part of a housing of a pole. In accordance thereto, the metal mount of the antenna cavity primary is to be understood as any kind of structure the cavity is mounted onto. However, according to a specific embodiment, the base substrate acts as ground plane of the cavity and is arranged with the antenna assembly, i.e. is part of the antenna.

The antenna can be arranged in its own plastic housing (radome), and then mounted e.g. on a vehicle through a metal pole (mast), on a haul truck (or other large vehicles), or through a mounting mechanism, typically some centimeters away from the roof on a vehicle.

At frequencies of around 900 MHz for the cavity antenna, a vehicle body can act as a ground plane. But as soon as the vehicle is out of the near-field of the antenna, it will only have secondary impact on the antenna impact, i.e. a deterioration of the radiation pattern. A carrying pole (i.e. antenna mast) will typically be placed in a region where will be no strong fields, hence will not impact on the antenna performance either.

Moreover, the antenna comprises a ground plane as part of the top substrate which provides a direct and compact combination of the cavity with an additional transmitting or receiving unit, e.g. a GNSS module or GNSS antenna. The ground plane or the additional unit is fed from the bottom side of the top substrate e.g. via a respective feeding pin protruding from the base substrate. By that, e.g. respective GNSS signals or controlling signals are transmittable (in both directions) via the pin.

Such design enables a compact integration of a GNSS module which typically is designed and arranged with its preferred radiation direction corresponding to a vertical plane so that interferences of GNSS signals and communication signals of the cavity are reduced or avoided.

The GNSS module ground plane is typically formed by a metal part of/on the top substrate.

Some embodiment of the invention relate to a multiband antenna assembly for transmitting or receiving signals within at least two frequency bands, comprising a monopole antenna with a top substrate (top plate) having defined dimensions and shape. The top substrate and a base substrate (bottom or ground plate) are arranged with defined distance relative to each other and define a cavity, wherein a first of the frequency bands is basically defined by the size of the top substrate, in particular of the resonator, i.e. width and length of the substrate or the cavity and/or the height, i.e. distance between the substrates. The influence of varying the distance can also be significant on the input impedance (which in turn again influences the resonance frequency). I.e. tuning of the first frequency band is at least enabled by varying the lateral size of the cavity and in particular the distance between the substrates.

The top substrate comprises a set of at least one slot, wherein a second frequency band basically is defined by the design and arrangement of the at least one slot, the second frequency band is different from the first frequency band. In particular, there are at least three slots which enclose a defined area on top of the top substrate. The second frequency band is tunable by respective sizes and shapes of the slots.

The whole cavity is designed so that the first and the second frequency band comprise preferred monopole sending and/or receiving directions substantially parallel to the extension of the substrates, in particular horizontally.

It is to be understood that the preferred monopole sending and/or receiving direction related to the first frequency band can differ from the preferred monopole sending and/or receiving direction of the second frequency band. For instance, the optimum radiation direction for the first frequency band is orthogonal to the optimum radiation direction for the second frequency band.

However, according to some embodiments of the invention, the preferred monopole directions particularly are substantially identical (at least parallel) to each other.

The top surface provides a ground plane for attaching an additional sending and/or receiving unit which provides a preferred sending and/or receiving direction different, in particular substantially orthogonal, to the preferred monopole sending and/or receiving directions. By such design compact combination of the antenna assembly with the additional device is possible with comparatively low effort and with avoiding interactions of signals to be transmitted or of electronics.

The antenna assembly also comprises a feed for transmission of signals to and/or from the additional sending and/or receiving unit, e.g. for supplying such an additional sending and/or receiving unit. The feed can be designed (embodied) as a feeding pin which protrudes from the base substrate and extends to the bottom side of the top substrate (facing the top side of the base substrate) in the region of the ground plane. By that, a channel for feeding the additional sending unit is provided while still very compact design is possible. RF signals and/or digital signals can be provided to the additional sending and/or receiving unit via the feed.

Alternatively or additionally, the feed may be realised by use of kind of coaxial cable conductively connected with the ground plate or with the additionally attached sending and/or receiving unit.

The surface of at least one of the substrates may comprise a metallic layer which extends over at least parts of the respective surface.

According to some embodiments of the invention, the base substrate and the top substrate are of planar shape and are arranged parallel to each other, in particular wherein the base substrate and the top substrate are of substantially identical shapes and/or dimensions. By that, the cavity of the monopole antenna device is well defined and provides optimised sending or receiving quality.

Regarding the defined generation of the second frequency band, the top substrate particularly comprises a set of at least four slots, the slots are arranged in adjacent manner so that a size and a shape of the ground plane is defined by the slots, in particular wherein the ground plane is represented by a part of the area of the top substrate surrounded by the slots, in particular wherein the slots are of equal sizes.

Such design and arrangement comprises two advantages. First, the second frequency bandwidth can precisely be defined by adjusting the dimensions of the slots, wherein a homogeneous radiation characteristic of the antenna is still given. Second, with arranging the slots in adjacent manner e.g. a rectangular or square area enclosed by the slots can be defined which simultaneously represents the ground plane at the top substrate.

According to an embodiment of the antenna assembly, a GNSS module is mounted to the ground plane, the GNSS module comprising a preferred sending and/or receiving direction substantially orthogonal to the preferred monopole sending and/or receiving direction. The GNSS module preferably receives (and sends) signals in the 1575 MHz GNSS L1 band (e.g. GPS, GLONASS, Galileo). A combined, integrated antenna is available which on the one hand provides mobile (terrestrial) communication e.g. from vehicle to vehicle or from and to a base station (over at least two frequency bands) and on the other hand provides reception of GNSS signals, e.g. GPS signals, and thus enables to continuously derive a precise position of the antenna device (as long as GNSS data is received). The position of the antenna or a vehicle the antenna is attached to can be transmitted via mobile communication channels accessible by the monopole antenna. Alternatively, the antenna assembly can comprise a so called "SatComm" antenna. Such antenna for satellite communication ("SatComm") can preferably be built as a sky-facing antenna for down- and uplink communications.

For example, at least one of the frequency bands of the monopole antenna corresponds to a mobile communication frequency band, in particular to at least a part of the ultra high frequency (UHF) band, dedicated short-range communications (DSRC), ISM, GSM, UMTS, LTE and/or WiFi. Thus, preferred communication parameters depending on respective usage of the antenna can be defined (tuned) and communication properties may be adapted to respectively given recommendations.

The antenna assembly can be designed so that the first frequency band defines a lower frequency band and the second frequency band defines an upper frequency band, wherein the frequencies provided by the upper frequency band are greater than frequencies provided by the lower frequency band. The centre frequency of the first frequency band is smaller than the centre frequency of the second frequency band.

According to some embodiments of the invention, the first frequency band comprises a centre frequency of about 900 MHz (e.g. 915 MHz) and the second frequency band comprises a centre frequency of about 2300 MHz or 2400 MHz (e.g. 2450 MHz) or up to a region about 2500 MHz (e.g. 2480 MHz). By such tuning of the antenna frequencies specific bands in the UHF region are accessible, wherein communication by e.g. WiFi, Bluetooth and/or cordless phone and/or over amateur radio is enabled. Sending and/or receiving in the UHF 33 cm and 13 cm bands can be realised that way.

Of course it is to be understood in context of the present invention that at least one of the frequency bands provided by the antenna device is tuned according to an alternative bandwidth which preferably corresponds to a specific communication band.

Concerning the tuning of particularly the second (upper) frequency band, the parameters of the second frequency band (e.g. centre frequency and bandwidth) may mainly depend on the size of the at least one slot, in particular depend on the length of the slot, wherein the centre frequency of the second frequency band decreases with increasing length of the slot.

Still relating to the tuning properties of the second frequency band, the length of the at least one slot is smaller than a wavelength corresponding to the centre frequency of the second frequency band, in particular is smaller than half that wavelength.

With view to create a small and compact antenna assembly the multiband antenna assembly can comprise at least one shorting via, in particular two or more shorting vias, connecting the base substrate and the top substrate for defining the resulting centre frequency of the first frequency band, wherein the shorting via effects a reduction of the centre frequency (while still providing compact antenna design).

The antenna assembly is designed so that at least one of the frequency bands of the monopole antenna is tunable by varying the distance between the base and the top substrate, the number of slots of the set of at least one slot, the shape and/or the dimension of the at least one slot, and/or the spatial position and/or dimension of the at least one shorting via. Furthermore, tuning can be performed by varying a size of the overall cavity (e.g. length and width of the ground plane). The frequency bands can thus be tuned with low effort (few changes in the antenna design) independently from each other.

A so called matching of the antenna is provided by e.g. tuning the antenna to 50 Ohms (or difference reference impedances) by tuning (defining) the slots sizes, substrate spacing, via widths and/or overall dimensions of the cavity.

Again relating to the sending or receiving characteristics of the antenna, the cavity is designed so that an optimum of sending radiation and/or reception quality regarding a directional characteristic of the monopole is provided omnidirectional in a parallel plane between the base and the top substrate. Those characteristic may in particular correspond to the shape of an apple or donut as mentioned above.

In that context, the directional characteristic may more specifically be defined by the course of the magnitude of sending radiation and/or the level of reception quality which may decrease with increasing dispersion angle relative to the plane. Finally, the sending or receiving ability of the antenna may tend to zero with approaching a direction orthogonal to the plane.

According to some embodiments of the invention, the monopole antenna can be designed so that a third or more frequency bands are provided by the antenna, wherein tuning of the third or more frequency bands is provided by respective design of the slots, the via, the size of the cavity and/or the distance between the base and the top substrate.

Concerning the supply of a possibly mounted additional communication device at the ground plane, the feeding pin can protrude from the centre of the base substrate and extend to the centre of the top substrate. Thereby, a less space consuming solution for feeding e.g. a GNSS module on top of the antenna can be provided. Signals and energy thus can be transported via the feeding pin to and from the additional module.

Furthermore, according to some embodiments of the invention, the base substrate can comprise an electronic circuit or real estate for such circuit for controlling and/or tuning the antenna assembly, in particular wherein the electronic circuit is implemented with PCB technology on the bottom side of the base substrate. For such approach, the base substrate can comprise a defined region which may be printed with respective circuits.

Some embodiment of the invention relate to the use of a multiband antenna assembly as described above in combination with a ground-bound moveable vehicle (e.g. car, truck). The antenna assembly here is arranged at the vehicle so that the preferred monopole sending and/or receiving direction basically corresponds to a horizontal direction, in particular in a normal state of the vehicle or by use of a specific mounting device.

The normal state of the vehicle is to be understood as an orientation of the vehicle, wherein respective wheels (or the like) of the vehicle are located in a plane the orientation of which basically corresponds to a horizontal plane. In correspondence or alternatively, the normal state corresponds to a horizontal orientation of that part of the vehicle the antenna device is attached to.

The normal horizontal orientation of the antenna assembly provides for improved vehicle to vehicle communication wherein a preferred vertical receiving direction for further GNSS signals is provided simultaneously.

The antenna assembly may be arranged at the vehicle using an additional tiltable and/or damped mounting device (e.g. gimbal mounting) for continuously providing a horizontal orientation of the antenna even in case the vehicle is significantly tilted towards the horizon.

Hence, the antenna assembly can be arranged with or can comprise a mounting device which provides swivelling and/or damping of an assembly alignment. In particular, the mounting device is represented by a gimbal mounting for providing automatic levelling of the antenna.

BRIEF DESCRIPTION OF THE FIGURES

The device according to the invention is described or explained in more detail below, purely by way of example, with reference to working examples shown schematically in the drawings. Specifically.

DETAILED DESCRIPTION

Figure 1:
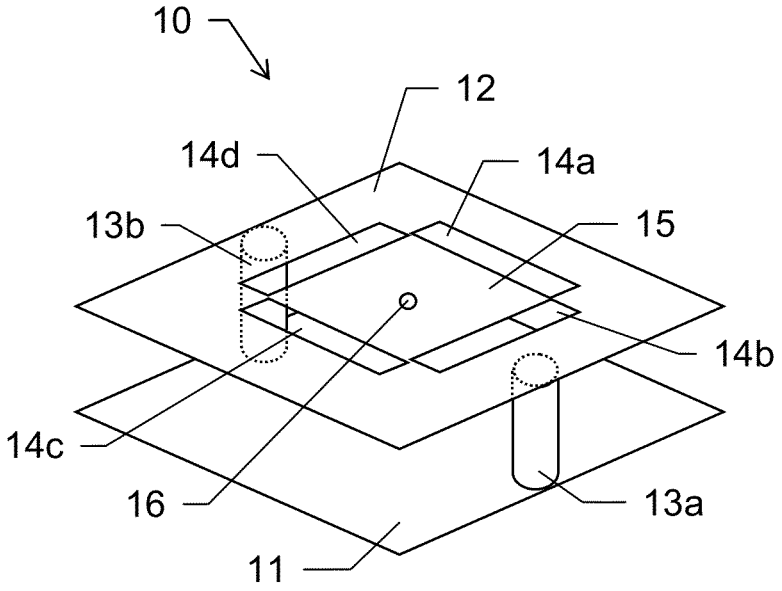
FIG. 1 shows an embodiment of a monopole, multiband antenna according to the invention.

FIG. 1 shows an embodiment of a monopole, multiband antenna 10 according to the invention. The antenna assembly 10 comprises a bottom substrate 11 (base substrate or bottom plate) and a top substrate 12 (top plate) arranged with defined distance relative to each other. The bottom substrate 11 and the top substrate 12 are of planar shape and arranged parallel to each other. Both substrates 11,12 extend over a basically identical rectangular, in particular quadratic, area.

The top plate 12 and the bottom plate 11 enclose a cavity of the antenna 10. The cavity provides a directional characteristic of the antenna in shape of a donut or apple, i.e. a preferred radiation is parallel to the substrates 11,12 and corresponds to the middle between these substrates 11,12, wherein the level of radiation (or reception) decreases with increasing radiating angles. The radiating angle is defined by an directional deviation from a parallel mid-plane between the substrates 11,12. In particular, there is no radiation output or input provided along an axis in a direction normal to at least one of the substrates. Such directional characteristic is enabled by the cavity radiating through its apertures according to its four side walls.

The antenna 10 additionally comprises two shorting vias 13*a* and 13*b* arranged between the base 11 and the top substrate 12. Such vias 13*a*,13*b* provide a significant reduction of the frequency level which defines a working frequency band of the cavity.

The top plate 12 comprises four slots 14*a-d* arranged in a rectangular manner. On the one hand, the slots 14*a-d* enable to define parameters for a second frequency band of the antenna 10, i.e. such second frequency band is tunable (to a given reference impedance) by variation of dimensions and arrangement of the slots 14*a-d*. On the other hand, the slots 14*a-d* define (enclose) a ground plane 15 on top of the top substrate 12. The ground plane 15 provides a basis for attaching a further component on the antenna, preferably attaching an additional sending and/or receiving unit like a GNSS module. A feeding pin which represents a feed for the ground plane 15 connects the ground plane 15 from the bottom for supplying such additional component with signals. A first end 16 of the feeding pin here is positioned in the centre of the ground plane 15.

Figure 2:
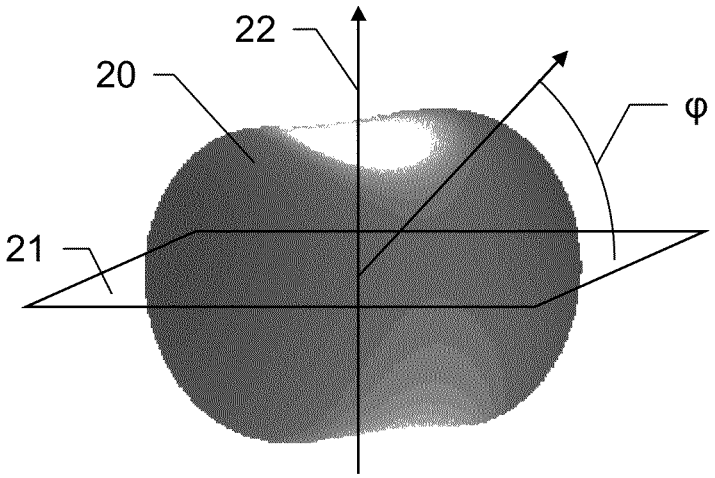
FIG. 2 shows a radiation profile of an antenna device according to the invention.

FIG. 2 shows a radiation profile 20 of an antenna device according to the invention, in particular of a multiband antenna of FIG. 1. The profile 20 is preferably of the shape of an apple or a donut. The directional characteristic 20 shows a maximum of magnitude of (sending or receiving) radiation according to a plane 21 in horizontal direction. Such plane 21 may correspond to a plane located between the base and the top substrate of a monopole antenna e.g. of FIG. 1, the plane being parallel to the respective substrates. In other words, the radiation level provided by an antenna device according to the invention provides a maximum in (circular) direction of the extensions of the cavity plates (omni-directional according to the plane 21).

As can be seen from FIG. 2 the radiation quality (level) of such antenna device basically decreases with increasing radiation angles φ. With an angular deviation of 90° (vertical axis 22, z-direction) the radiation emittable or receivable by a respective antenna device tends to or is equal to zero.

The shown radiation profile 20 may represent a respective radiation pattern at about 900 MHz and/or 2400 MHz.

By such design of the directional characteristic, interferences possibly resulting from mutual interactions of basically horizontally oriented signals of a cavity and basically vertically oriented signals of an attached (on the ground plane of the top substrate) GNSS module can be significantly reduced or even be avoided. Therefore, a monopole, multiband antenna according to the invention, e.g. according to the design of FIG. 1, provides a well adjusted and quite compact antenna arrangement, in particular for use in vehicle-to-vehicle communications where also availability and processing of GNSS signals is desired or required.

A typical example use of an antenna assembly according to the invention belongs to the field of mining for generating proximity warnings. At least two vehicles (or persons) in the mining area are equipped with such antenna assembly, wherein the vehicles comprise an additional GPS-module either directly mounted to the antenna assembly or arranged separately at the vehicle. The antenna assemblies are arranged with horizontal orientation. Positions of the respective vehicles are continuously derived by use of the GNSS-modules. The actual positions are transmitted and received between each others by use of the antenna assemblies. A processing unit compares an actual position the antenna assembly/GNSS-module connected to the processing unit and the actual position of the other remote antenna assembly/GNSS-module. In case of recognising a mutual approach of the antennas/modules which is supposed to lead to a collision or in case of simply coming below a defined minimum relative distance a respective warning signal is generated in order to warn the operator of the vehicle and/or the person.

In such context, continuous communication between the respective vehicles (or persons) is necessary for most reliable generation of warning signals. Such continuous communication can perfectly be provided by the antenna assembly according to the invention (due to its radiation characteristic).

Figure 3:
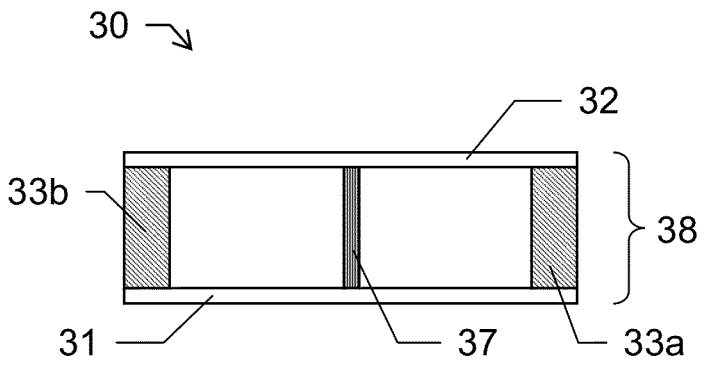
FIG. 3 shows an embodiment of an antenna device according to the invention from a side perspective.

FIG. 3 shows an embodiment of an antenna device 30 according to the invention from a side perspective. The antenna device 30 is designed as a low-profile magnetic loop monopole multiband antenna. The antenna 30 is based on a square substrate-integrated cavity 38 radiating through apertures in its four side walls. This effectively creates a small square loop of magnetic currents, which radiates omni-directionally as an electric monopole. The antenna cavity 30 has a side length of less than $\lambda_0/3$ and thus resonates in the monomode region, in a fundamental TMii mode. The height of the cavity 38 in particular is of less than $\lambda_0/16$. Here $\lambda_0$ refers to a first frequency band of the antenna 30 mainly defined by the dimensions of the cavity 38. Such first frequency band preferably is tuned to be of lower frequencies than a second band set and tuned by slots in the upper substrate 32.

The antenna 30 comprises two shorting vias 33*a*,33*b* which provide tuning of the cavity 38 according to lower frequency regions while reaching a more compact design of the antenna.

Furthermore, a feeding pin 37 is arranged for providing a defined space (channel) between the bottom substrate 31 and the top substrate 32 for feeding a possibly additionally arranged module on top of the upper plate 32.

The feeding pin 37 can be of a cylindrical or of a conical/bell shape (with which a larger bandwidth could be achieved).

The pin 37 also provides a connection to the bottom side of the bottom substrate 31 so that an electrical connection can be enabled that way by e.g. wires, a micro-strip integrated in the bottom substrate 31 or a printed circuit at the bottom side of the bottom substrate 31.

Figure 4:
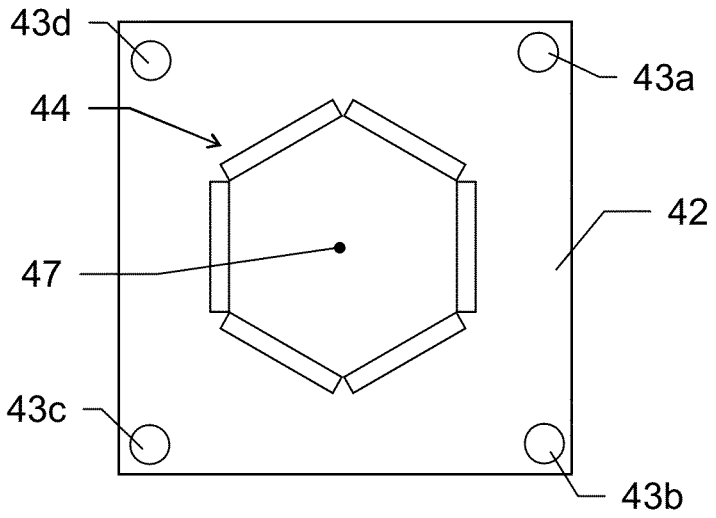
FIG. 4 shows a further embodiment of an antenna according to the invention in top-view perspective.

FIG. 4 shows a further embodiment of an antenna according to the invention in top-view perspective. The top substrate 42 comprises six recesses 44 (slots) arranged in hexagonal manner so that a ground plane for mounting an additional communication module is defined by the area enclosed by the recesses 44. Furthermore, four shorting vias 43*a-d* are arranged between the bottom and the top substrate 42 for defining a particular distance between the substrates and influencing the resulting frequency band of the cavity. As can be seen, a connection pin 47 provides signal connection to the ground plane by ending in the midpoint of that plane.

Such design provides the advantage of omni-directional (horizontal) sending/receiving in multiple frequency bands (in particular two) while additionally providing a mounting area for attaching a further module and thus enabling compact combination of monopole, multiband antenna properties with a further communication device (e.g. GNSS-module).

Figure 5:
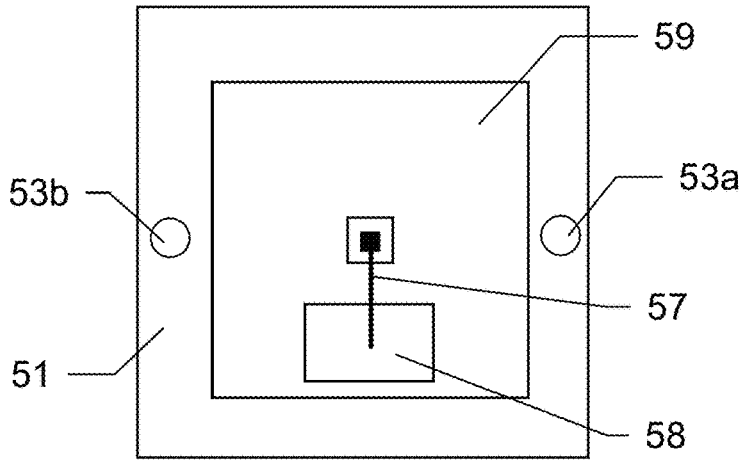
FIG. 5 shows a bottom view of a bottom plate (base substrate) of an antenna device according to the invention.

FIG. 5 shows a bottom view of a bottom plate 51 (base substrate) of an antenna device according to the invention. Contacting areas of two shorting vias 53*a*,53*b* are depicted as well as a microstrip 57 integrated in the bottom plate 51 for supplying a feeding pin emerging from the top side of the bottom plate 11 and thus feeding a possibly mounted GNSS-module or the like.

The microstrip line 57 is to feed the monopole antenna. A gap to an area on the ground plate for implemented control circuits 59 or the like is provided to allow an EM-wave (electromagnetic wave) to enter the monopole antenna. The feed for the GNSS module comes through the feeding pin. The feed would be provided with a coaxial cable or digital cable.

Hence, the GNSS module would be fed through an additional mean, as mentioned here with a cable. However, alternatively, feeding can be provided directly by the feeding pin, e.g. by the feeding pin itself comprising a coaxial cable or being embodied as a coaxial cable. In such case an additional cable to the GNSS module can be avoided.

In particular, a semi-rigid coaxial forms the feeding pin, where the outside conductor is the actual pin, and the cable is lead to the top of the antenna, where is connected to the GNSS module.

Furthermore, the bottom substrate 51 comprises real estate for RF/control circuits. This means that main electronics of the antenna device can directly be integrated in the device, i.e. at the bottom of the device, by designing the real estate with PCB technology. In particular, the required RF circuitry is directly arranged on the bottom substrate. Such design allows for low-cost PCB material with no significant losses, as opposed to special RF materials at much higher costs.

As can be seen the microstrip 57 here is connected to a RF circuitry 58 which is arranged with the ground plate 59.

According to an alternative embodiment (not shown), the microstrip or a further such microstrip may be provided for (also) feeding the monopole antenna.

Figure 6:
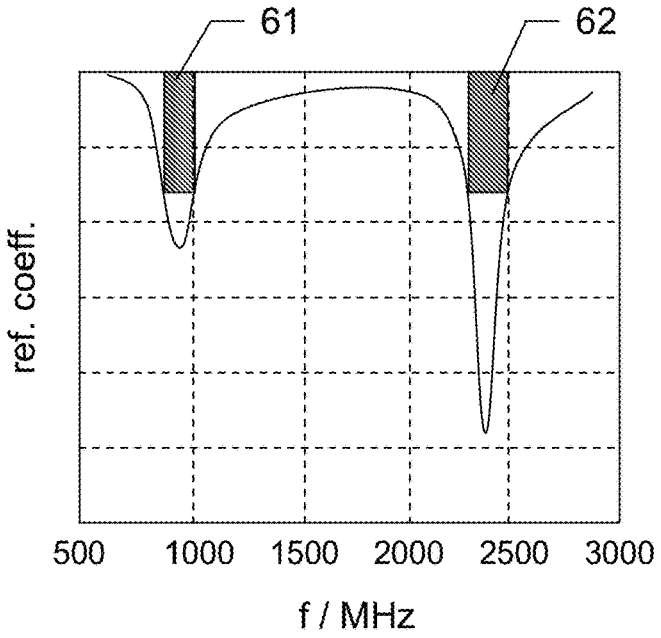
FIG. 6 shows a chart concerning the reflection coefficient of a multiband antenna device according to the invention.

FIG. 6 shows a chart concerning a reflection coefficient (ref. coeff.) of a multiband antenna device according to the invention.

The referred antenna device is configured so that two frequency bands 61 and 62 are defined. The first frequency band 61 is located around 900 MHz, i.e. the centre frequency of that bandwidth basically corresponds to 900 MHz, and the second band 62 is in the region of about 2400 MHz.

The first frequency band 61 may mainly be tunable by setting a defined distance between a bottom and a top substrate of the antenna and/or designing top and bottom substrate with defined widths and lengths. The second band 62 may preferably be tuneable by respective design of the slots of the top substrate of the antenna.

In particular, a careful design of the gap, the ground plane and the shorting vias allows tuning of resonances and impedances to desired frequency bands 61,62 as well, e.g. with a defined reflection coefficient (e.g. below −6 dB or −10 dB).

Therefore, due to the specific design of such antenna device, a precise tuning of the antenna device according to at least two frequency bands is possible, wherein an advantage of such approach is enabling two defined frequency bands without the need of a specific filtering unit. The bandwidth of the antenna also depends on the height (distance between the substrates), i.e. higher antenna=larger bandwidth.

Although the invention is illustrated above, partly with reference to some specific embodiments, it must be understood that numerous modifications and combinations of different features of the embodiments can be made and that the different features can be combined with each other or with principles of antenna design and/or of antenna tuning known from prior art.

What is claimed is:

1. A multiband antenna assembly for transmitting or receiving signals in at least two frequency bands, the multiband antenna assembly comprising a monopole antenna with a top substrate having defined dimensions and shape, wherein the top substrate and a base substrate are arranged with defined distance relative to each other and define a cavity, wherein a first frequency band is basically defined by the dimension of the top substrate, the top substrate comprises a set of at least one slot, wherein a second frequency band basically is defined by the design and arrangement of the at least one slot, the second frequency band is different from the first frequency band, the cavity is designed so that the first and the second frequency band comprise preferred monopole sending and/or receiving directions substantially parallel to the extension of the substrates, the top substrate provides a ground plane for attaching an additional sending and/or receiving unit which provides a preferred sending and/or receiving direction that is different to the preferred monopole sending and/or receiving directions, the antenna assembly comprises a feed for transmission of signals to and/or from the additional sending and/or receiving unit.

2. The multiband antenna assembly according to claim 1, wherein:

the feed is designed as a feeding pin protruding from the base substrate and extending to the bottom side of the top substrate in the region of the ground plane, wherein the feeding pin protrudes from the centre of the base substrate and extends to the centre of the top substrate.

3. The multiband antenna assembly according to claim 1, wherein:

the base substrate is represented by a surface of a body the multiband antenna assembly is mounted onto a housing of a radome, a roof of a vehicle, or by a housing of a pole.

4. The multiband antenna assembly according to claim 1, wherein:

the base substrate and the top substrate are of planar shape and are arranged parallel to each other, wherein the base substrate and the top substrate are of substantially identical shapes and/or dimensions.

5. The multiband antenna assembly according to claim 1, wherein:

the top substrate comprises a set of at least four slots, the slots are arranged in adjacent manner so that a size and a shape of the ground plane is defined by the slots, wherein the ground plane is represented by a part of the area of the top substrate surrounded by the slots, wherein the slots are of equal sizes.

6. The multiband antenna assembly according to claim 1, wherein:

a GNSS module mounted to the ground plane, the GNSS module comprising a preferred sending and/or receiving direction substantially orthogonal to the preferred monopole sending and/or receiving directions.

7. The multiband antenna assembly according to claim 1, wherein:

the first frequency band defines a lower frequency band and the second frequency band defines an upper frequency band, wherein the frequencies provided by the upper frequency band are greater than frequencies provided by the lower frequency band.

8. The multiband antenna assembly according to claim 1, wherein:

the frequency bands of the monopole antenna correspond to mobile communication frequency bands dedicated short-range communications (DSRC), ISM, GSM, UMTS, LTE and/or WiFi.

9. The multiband antenna assembly according to claim 1, wherein:

the first frequency band comprises a centre frequency of about 900 MHz and the second frequency band comprises a centre frequency of about 2400 MHz.

10. The multiband antenna assembly according to claim 1, wherein:

parameters of the second frequency band depend on the length of the at least one slot, wherein the centre frequency of the second frequency band decreases with increasing length of the slot.

11. The multiband antenna assembly according to claim 1, wherein:

the length of the at least one slot is smaller than a wavelength corresponding to the centre frequency of the second frequency band.

12. The multiband antenna assembly according to claim 1, wherein:

the multiband antenna assembly comprises at least one shorting via connecting the base substrate and the top substrate for defining the resulting centre frequency of the first frequency band, wherein the shorting via effects a reduction of the centre frequency.

13. The multiband antenna assembly according to claim 1, wherein:

at least one of the frequency bands of the monopole antenna is tunable by varying:

the distance between the base and the top substrate, the dimension of the base substrate and/or the top substrate, the number of slots of the set of at least one slot, the shape and/or the dimension of the at least one slot, and/or the spatial position and/or dimension of the at least one shorting via.

14. The multiband antenna assembly according to claim 1, wherein:

the cavity is designed so that an optimum of sending radiation and/or reception quality regarding a directional characteristic of the monopole is provided omnidirectional in a parallel plane between the base and the top substrate.

15. The multiband antenna assembly according to claim 1, wherein:

the magnitude of sending radiation and/or the level of reception quality decreases with increasing dispersion angle relative to the plane.

16. The multiband antenna assembly according to claim 1, wherein:

the monopole antenna is designed so that a third or more frequency bands are provided, wherein tuning of the third or more frequency bands is provided by respective design of the slots, the via and/or the distance between the base and the top substrate.

17. The multiband antenna assembly according to claim 1, wherein:

the base substrate comprises an electronic circuit for controlling and/or tuning the antenna assembly, wherein the electronic circuit is implemented with PCB technology on the bottom side of the base substrate.

18. The multiband antenna assembly according to claim 1, wherein:

the antenna assembly is arranged with a mounting device which provides swivelling and/or damping of an assembly alignment, wherein the mounting device is represented by a gimbal mounting for providing automatic levelling.

19. The multiband antenna assembly according to claim 1, wherein:

the multiband antenna assembly is coupled with a ground-bound moveable vehicle, wherein the antenna assembly is arranged at the vehicle so that the preferred monopole sending and/or receiving directions basically corresponds to a horizontal direction.

20. A multiband antenna assembly for transmitting or receiving signals in at least two frequency bands, comprising a monopole antenna with a top substrate having defined dimensions and shape, wherein the top substrate and a base substrate are arranged with defined distance relative to each other and define a cavity, wherein a first frequency band is basically defined by the top and the base substrate and by the present distance, the top substrate comprises a set of at least one slot, wherein a second frequency band basically is defined by the design and arrangement of the at least one slot, the second frequency band is different from the first frequency band, the cavity is designed so that the first and the second frequency band comprise preferred monopole sending wherein receiving directions substantially horizontally to the extension of the substrates, the top substrate provides a ground plane for attaching an additional sending wherein receiving unit which provides a preferred sending wherein receiving direction that is substantially orthogonal to the preferred monopole sending wherein receiving directions, the antenna assembly comprises a feed for transmission of signals to wherein from the additional sending wherein receiving unit.

* * * * *